United States Patent [19]

Christiani

[11] 4,351,164

[45] Sep. 28, 1982

[54] POROUS SALAD BOWL INCLUDING RIBBED LID FOR COOLING

[76] Inventor: Peter Christiani, 145 S. Western Ave., Apt. 121, Anaheim, Calif. 92804

[21] Appl. No.: 261,907

[22] Filed: May 8, 1981

Related U.S. Application Data

[63] Continuation of Ser. No. 112,163, Jan. 14, 1980, abandoned.

[51] Int. Cl.[3] ..... F25D 1/00

[52] U.S. Cl. ..... 62/315; 62/371; 62/457; 220/23.83; 220/287; 312/31.04; 426/109; 426/112; 426/419; 426/506; 426/524

[58] Field of Search ..... 312/31.04; 426/419, 426/524, 394, 112, 506, 106, 109, 112; 62/315, 371; 220/23.83, 287

[56] References Cited

U.S. PATENT DOCUMENTS

| | | | |
|---|---|---|---|
| 103,473 | 5/1870 | Klee et al. | 312/31.04 |
| 264,184 | 9/1882 | Miller | 312/31.04 |
| 363,625 | 5/1887 | Foote | 312/31.04 |
| 539,727 | 5/1895 | Cutler | 312/31.04 |
| 1,017,217 | 2/1912 | Jones | 312/31.04 |
| 2,128,218 | 8/1938 | Bennett | 312/31.04 |
| 3,240,610 | 3/1966 | Cease | 426/394 |
| 3,244,537 | 4/1966 | Cease | 426/394 |
| 3,710,589 | 1/1973 | Brown et al. | 62/371 |

FOREIGN PATENT DOCUMENTS

| | | | |
|---|---|---|---|
| 234603 | 6/1925 | United Kingdom | 312/31.04 |

*Primary Examiner*—Steven L. Weinstein

*Attorney, Agent, or Firm*—William H. Pavitt, Jr.; Natan Epstein

[57] ABSTRACT

A hollow vessel of unglazed terra cotta pottery which, when moistened, keeps the temperature of a salad below room temperature when it is removed from the refrigerator to the dining table for comsumption. Leftover salad, even when impregnated with salad dressing, may be stored in this vessel in the refrigerator for several days, without losing either its crispness or its flavor.

1 Claim, 3 Drawing Figures

POROUS SALAD BOWL INCLUDING RIBBED LID FOR COOLING

This is a continuation of application Ser. No. 112,163, filed Jan. 14, 1980, now abandoned.

BACKGROUND

It is well known that after a porous material has been exposed to moisture or water, some of the moisture will be absorbed by the material, and that thereafter evaporation of the moisture from the material will produce cooling of the material.

This principle has been applied to the cooling of a bottle of wine. To this end, a hollow cylindrical unglazed porous terra cotta vessel is provided. In use, the vessel is flushed with water and then emptied, and the wine bottle is then inserted into the vessel, and evaporation of the water cools the vessel and the wine bottle.

Although the physical principle involved is very old, its application to a salad bowl has been found to be uniquely advantageous, as will be discussed below.

Salad greens are typically cut in small batches on the day of intended use, because the cut greens tend to wilt and dry out when stored in conventional vessels. It would be more efficient if several days' supply of greens could be chopped all at once and stored for use on successive days.

Frequently, after a salad dressing has been added to the chopped greens and the salad has been mixed, it is found that too much salad has been prepared. Typically, leftover salad deteriorates rapidly even when stored at normal refrigerator temperatures. This problem is caused partly by the fact that the bowl from which the salad is served warms up to room temperature during the meal and before the leftovers are stored away.

As will be seen below, the salad bowl of the present invention is useful in relieving the above-discussed problems, making possible a new technique for the management of salad preparation, serving, and storage.

SUMMARY OF THE INVENTION

In accordance with the present invention, a salad bowl and a lid for the salad bowl are composed of an unglazed porous terra cotta pottery. After being flushed with water, both the bowl and lid are cooled by evaporation, thereby keeping the salad cooled to a temperature below room temperature at all times. This is very important in maintaining the freshness of the salad material.

In a preferred embodiment, the lid of the salad bowl is slightly domed. When salad materials are being stored in the salad bowl, the lid is placed on the salad bowl with the convex side of the lid upwards. The space within the concave side of the lid is divided by ribs which form a unitary structure with the rest of the lid, so as to divide the space into a number of compartments. The lid can be placed on the bowl with the concave side up to permit the lid to be used as a serving as a serving tray, while any salad materials remaining in the bowl are maintained at a cool temperature. This prolongs the life of the salad materials stored in the bowl.

Salad greens to which the salad dressing has not yet been applied can be kept fresh for a period of three or four days in a refrigerator when kept in the salad bowl of the present invention, provided the salad bowl has been saturated with water. Evaporation from the salad bowl cools the bowl and the materials in it to a temperature lower than the normal temperature within the refrigerator. Also, it is believed that the bowl supplies moisture to the salad within it, and this also helps to keep the salad fresh.

When the time has arrived to serve the salad, the bowl is removed from the refrigerator, the lid is removed, and the salad dressing is mixed with the salad greens. The salad bowl is then transferred to the table, and the salad is served from the salad bowl. With conventional salad bowls, the temperature of the salad ingredients gradually increases after the salad has been placed on the table, but with the present invention, the salad is maintained at a temperature below room temperature during the meal. This greatly retards deterioration of the salad by preventing it from reaching room temperature.

As pointed out above, the lid of the salad bowl may be inverted so that its concave side is upward, and when the lid is sitting on the bowl in this position, the lid may be used as a serving tray for garnishes or for a small portion of the salad, while at the same time the presence of the inverted lid helps to maintain a cooler temperature within the salad bowl.

After the meal, any leftover salad to which the dressing has already been applied may be stored in the salad bowl in the refrigerator. In the best mode of practising the invention, it is desirable to saturate the lid of the bowl with water prior to replacing the lid on the bowl containing the leftovers, before the covered bowl is returned to the refrigerator. It is believed that any oil that was present in the salad dressing will tend to clog the pores on the inside surface of the bowl, and this helps to prevent the applied salad dressing from drying out during storage.

Thus, it is seen that the salad bowl and lid of the present invention is particularly well adapted for preventing deterioration of salads and thereby provides a new and useful technique for the management of salad preparation and storage.

The novel features which are believed to be characteristic of the invention, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

Figure 3:
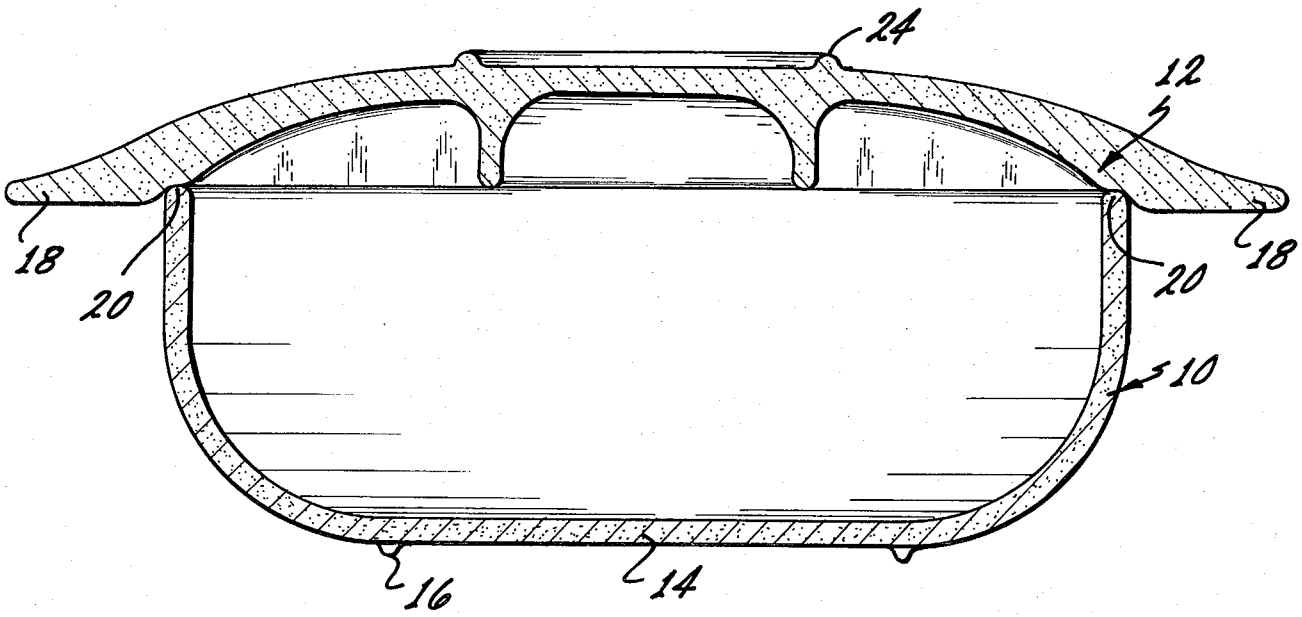

Turning now to the drawings, which illustrate a preferred embodiment of the present invention, it is seen in FIG. 3 that the invention includes a salad bowl 10 and a lid 12. The bowl is relatively deep and has a substantially flat bottom 14. A ring 16 centered on the bottom 14 helps to prevent contact between the bottom 14 and the table on which the bowl rests, so as to minimize the flow of heat into the cool bowl 10 form the warmer table top.

The lid 12 includes projections 18 which overhang the lip 20 of the bowl 10 so as to serve as handles for removing the lid 12 from the bowl 10.

Figure 1:
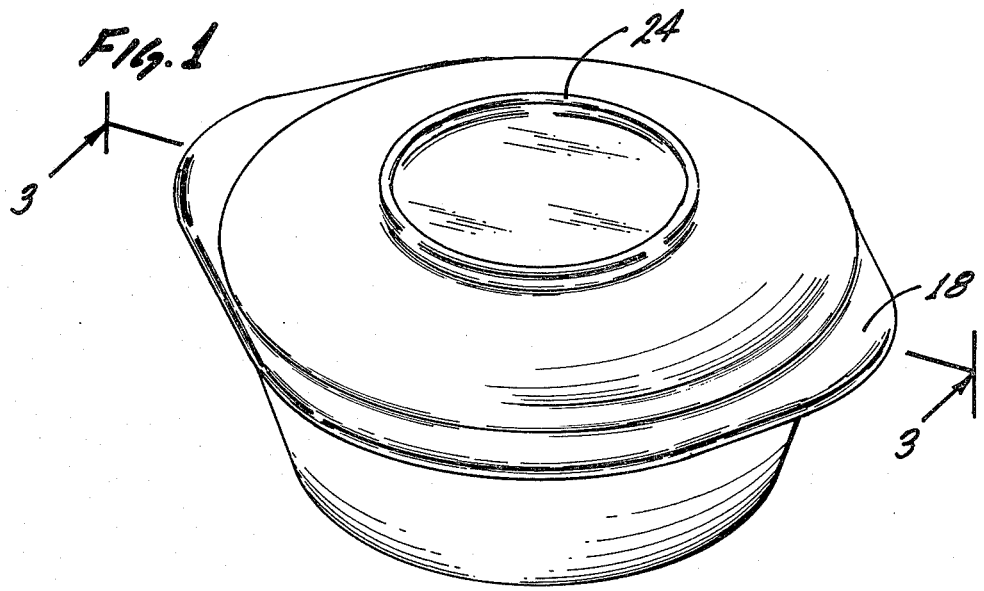
FIG. 1 is a perspective view showing a preferred embodiment of the salad bowl of the present invention with the lid in place.
Figure 2:
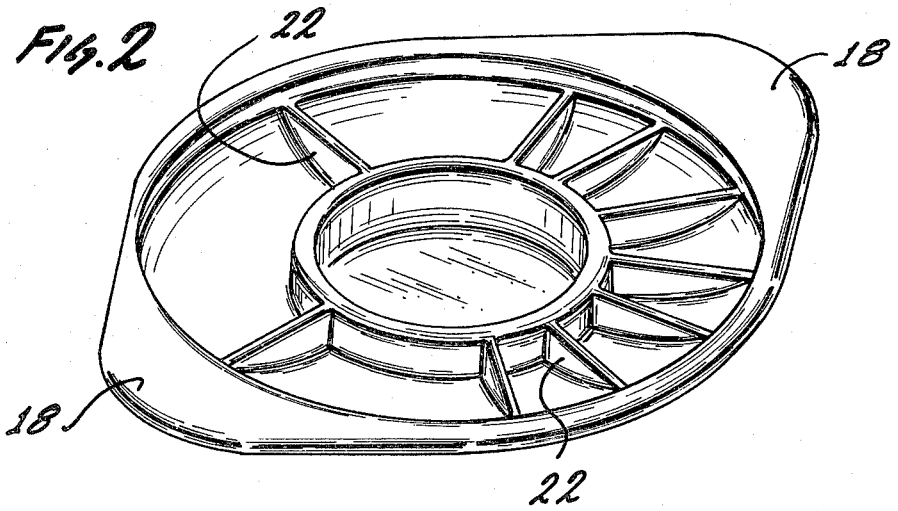
FIG. 2 is a perspective view showing the concave underside of the lid in a preferred embodiment; and, FIG. 3 is a cross-sectional view in the direction 3—3 shown in FIG. 1.

In a preferred embodiment, the space within the concave underside of the lid is divided by ribs 22 into a number of smaller compartments from which food can be served when the lid is used in the inverted position shown in FIG. 2 as a serving tray. When used as a serving tray, the inverted lid may be placed on top of the bowl 10 to help prevent loss of cooling from the bowl, or, alternatively, the inverted lid 12 may be used independently of the bowl. A ring 24 at the top of the convex side of the lid 12 helps to prevent transfer heat to the lid 12, when the lid is placed on a table with the concave side up.

Both the bowl 10 and the lid 12 are made of a porous unglazed terra cotta pottery. The porosity of the material enables the bowl and the dish to absorb and store liquids such as water for a limited time. However, as time passes, the absorbed liquid gradually evaporates from the bowl and lid, thereby cooling them, and this removes heat from the materials stored in the bowl.

If the cooling effect is to be produced, the bowl 10 and the lid 12 must be flushed with water or, preferably, immersed briefly in water. When the bowl and the lid are removed from the water, their surfaces will appear to be moist, but the retained water does not drip out of the bowl and the lid.

As pointed out above, the salad bowl of the present invention makes possible greater efficiency in the preparation of salads, because a large amount of greens can be chopped at one time and stored in several bowls of the type described herein. The stored chopped greens may be kept in a fresh condition in the refrigerator in the bowls for three or four days. This favorable achievement is the result of evaporation from the bowl and lid, which maintains the temperature in the bowl below the temperature prevailing in the refrigerator.

When the time has come to serve one of the salads, the bowl is removed from the refrigerator, the dressing is poured into the bowl, and the salad is mixed in the bowl. This assures that the salad bowl will be prechilled.

Once the salad bowl has been set on the table, evaporation of water from the bowl continues to remove heat from the contents of the bowl, thereby keeping the salad cold while it is on the table. This has been found to be an important aspect of the invention, because the salad does not deteriorate as rapidly because its temperature is maintained below room temperature.

As mentioned above, the lid of the salad bowl may be placed with its concave side up on top of the bowl 10 to prevent the influx of heat.

After the meal, the leftover salad can be left in the bowl 10. Preferably, the lid 12 is again flushed or immersed in water and placed on the bowl. Thus covered, the bowl should be placed back in the refrigerator where the leftovers will keep for a day or two in good condition. Moisture from the bowl and lid tends to keep the salad and the dressing from drying out during this phase of storage.

The foregoing detailed description is illustrative of one embodiment of the invention, and it is to be understood that additional embodiments thereof will be obvious to those skilled in the art. The embodiments described herein, together with those additional embodiments, are considered to be within the scope of the invention.

What is claimed is:

1. In a bowl of unglazed porous material that is sufficiently porous for cooling of foods contained therein by evaporation of liquid previously absorbed by said porous material when said porous material has been moistened and defining a cavity for receiving said foods, said bowl having a bottom and an upper rim and including a unitary dished lid of said porous material having a concave side and a convex side, the improvement comprising:

ribs integral with and extending upwardly from said concave side of said lid and dividing said concave side into a plurality of serving compartments, said ribs also increasing the total surface area of said concave side relative to the surface area of said convex side to thereby increase the rate of evaporation of said liquid from said lid to thus improve the cooling of said foods, said convex side being of shallow curvature relative to said bowl cavity so that said lid may be inverted on said rim without substantially extending into said bowl cavity, such that said lid may be inverted on said rim between a concave side down position and a concave side up position for selecting a higher or a lower rate of evaporative cooling of said covered foods, and when placed with said ribbed, concave side up said lid is also useful as a chilled serving tray while simultaneously covering and cooling the contents of said bowl.

* * * * *